US007398610B2

(12) United States Patent
McMullin

(10) Patent No.: US 7,398,610 B2
(45) Date of Patent: Jul. 15, 2008

(54) FOOTWEAR CLEAT WITH BLADE-LIKE TRACTION ELEMENTS

(75) Inventor: Faris W. McMullin, Boise, ID (US)

(73) Assignee: Softspikes LLC, Brentwood, TN (US)

( * ) Notice: Subject to any disclaimer, the term of this patent is extended or adjusted under 35 U.S.C. 154(b) by 0 days.

(21) Appl. No.: 11/388,191

(22) Filed: Mar. 24, 2006

(65) Prior Publication Data

US 2006/0230639 A1 Oct. 19, 2006

Related U.S. Application Data

(60) Provisional application No. 60/664,630, filed on Mar. 24, 2005.

(51) Int. Cl.
*A43C 15/02* (2006.01)

(52) U.S. Cl. ..... 36/127

(58) Field of Classification Search ..... 36/127 O, 36/134 X, 59 R, 67 D
See application file for complete search history.

(56) References Cited

U.S. PATENT DOCUMENTS

| | | | | | |
|---|---|---|---|---|---|
| 5,367,793 | A | * | 11/1994 | Deacon et al. | 36/127 |
| D372,355 | S | | 8/1996 | Deacon et al. | |
| D375,192 | S | | 11/1996 | Bathum | |
| D392,451 | S | * | 3/1998 | Collins et al. | D2/962 |
| D395,542 | S | * | 6/1998 | Collins | D2/962 |
| 6,023,860 | A | * | 2/2000 | McMullin | 36/127 |
| 6,041,526 | A | * | 3/2000 | Collins | 36/127 |
| 6,209,230 | B1 | * | 4/2001 | Curley, Jr. | 36/127 |
| 6,381,878 | B1 | | 5/2002 | Kennedy, III et al. | |
| D513,359 | S | * | 1/2006 | McMullin | D2/962 |

* cited by examiner

*Primary Examiner*—Ted Kavanaugh
(74) *Attorney, Agent, or Firm*—Edell, Shapiro & Finnan, LLC

(57) ABSTRACT

A shoe cleat comprises a fan-like array of dynamic traction elements that, under the weight of a wearer of a shoe, resiliently deflect toward the cleat hub and are compressed against an adjacent traction element and/or the hub to trap interposed grass blades.

10 Claims, 4 Drawing Sheets

FOOTWEAR CLEAT WITH BLADE-LIKE TRACTION ELEMENTS

CROSS-REFERENCE TO RELATED APPLICATION

This application claims priority from U.S. Provisional Patent Application Ser. No. 60/664,630 entitled "Footwear Cleat With Blade-Like Traction Elements," filed Mar. 24, 2005. The disclosure of this provisional patent application is incorporated herein by reference in its entirety.

BACKGROUND OF THE INVENTION

1. Field of the Invention

The present invention pertains generally to cleats for use with athletic shoes worn on turf and other surfaces. In particular, the present invention pertains to improvements in the golf cleat disclosed in my prior U.S. Pat. No. 6,023,860 (referred to herein as "my '860 patent").

2. Discussion of the Related Art

In my aforesaid '860 patent there is disclosed a removable cleat for use with an athletic shoe for providing traction to a user on a turf surface without damaging the turf surface, and also providing traction on hard surfaces, carpeting and other flooring without damaging that flooring. That removable cleat comprises a hub having a first or upper side facing the shoe sole and a second or bottom side facing away from the shoe sole. A hub attachment means extends from the first side for attaching the hub to one of the plural attachment means located on or in the shoe sole. Plural traction elements extend outward and downward in cantilevered fashion from the hub periphery, each traction element having a turf-engaging portion projecting away from the bottom side of the hub for engagement with turf blades to provide traction without puncturing turf. The traction element is resiliently deflectably attached to the hub so that the turf-engaging portion deflects upward toward the shoe sole at a location beyond the hub periphery when it encounters a hard surface under load, thereby minimizing wear of the turf-engaging portion of the traction element by the hard surface. The relatively broad and substantially flat outward surface of the traction element tends to trap grass blades against the sole of the shoe to enhance traction. Although effective to provide traction, the spreading out of the traction elements results in a relatively large area of the shoe sole being dedicated to a single cleat. In addition, the spreading action places the traction element under tension which limits the life of the element since the tension forces tend to try to tear the element at its root.

Thus, where the traction elements of the cleat of my aforesaid '860 patent spread open under load, beyond the hub periphery, the traction elements of the present invention close or fold over onto or toward one another in gripping grass blades between them, or against the hub, to effect the desired traction. In addition, the traction elements of the present invention are compressed under load, rather than being placed under tension, thereby minimizing the tendency of the element to rip or tear during use.

OBJECTS AND SUMMARY OF THE INVENTION

The present invention takes a different approach to providing traction, and in so doing provides a cleat that is more compact in that it occupies less area on the sole of the shoe than is required for the cleat described in my '860 patent. In particular, when not under load, the traction elements, instead of extending outwardly and downwardly from the periphery of the cleat hub, extend blade-like (much like the blades of a turbine), diverging in size outwardly from proximate the hub center and twisting so as to be non-planar. Depending on the size of the traction elements and the spacing between them, the twisted radially outer portion of each blade element overlies either a portion of the hub, or an adjacent blade element, or both, in non-contacting relation when not under load. Since these traction elements are resiliently deflectably attached to the hub bottom surface along a long edge of the traction element, their turf-engaging portions deflect upwardly toward the hub bottom surface when they encounter a weight load. In this manner the blade-like traction elements under load tend to close inwardly over or onto the hub, or over or onto one another or both, depending on the particular configuration. Thus, the elements under load trap grass blades against the bottom surface of the hub and/or between themselves. In other words, the dynamic traction blades fold over onto each other or onto the hub of and thereby perform the dynamic action of trapping the grass blades. The cleat of the present invention has a high level of durability since most of each traction element is in compression while under load, rather than in tension as is the case with most other dynamic traction elements.

DESCRIPTION OF THE PREFERRED EMBODIMENTS

Figure 1:
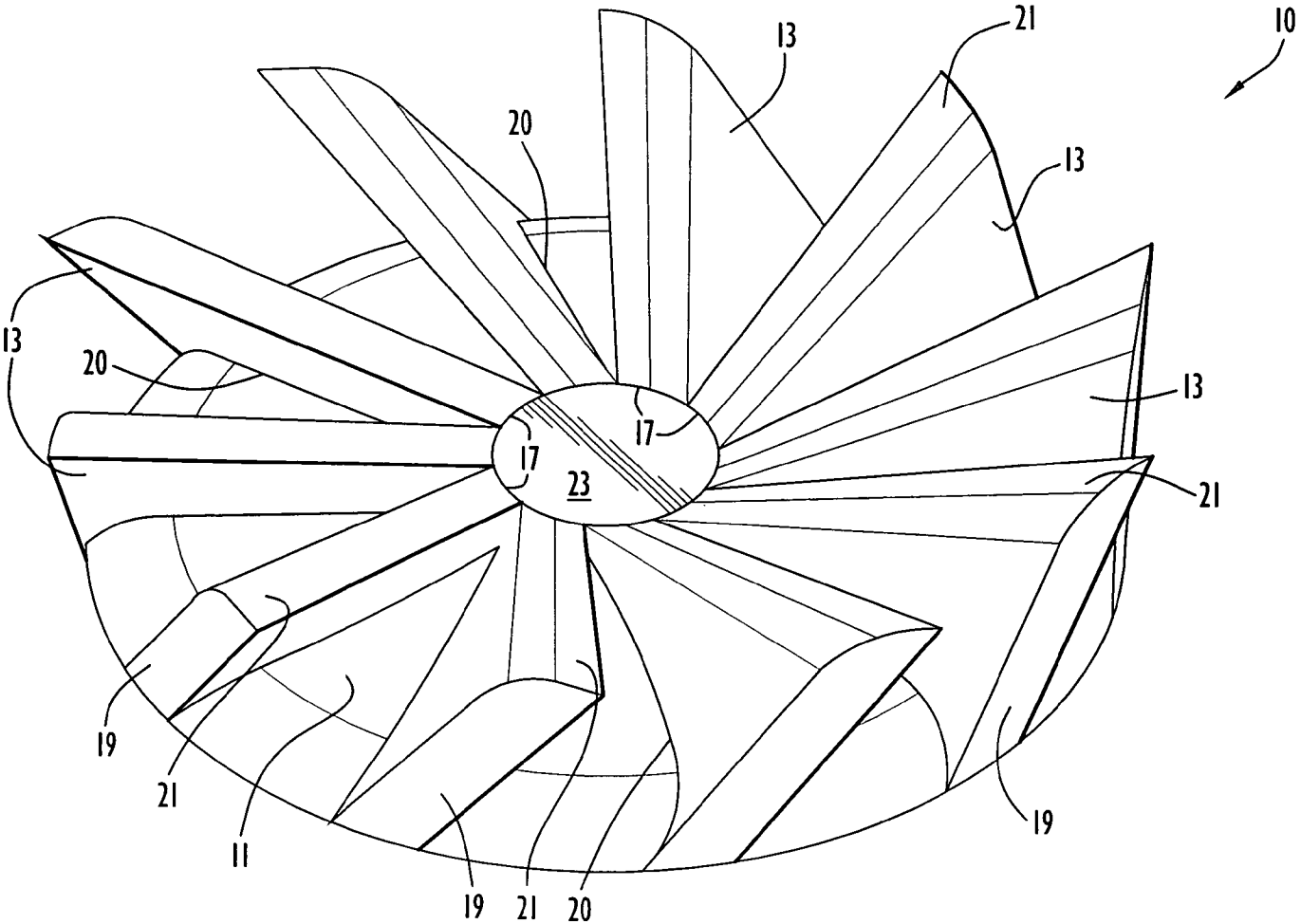
FIG. 1 is a view in perspective of the bottom or traction side of an exemplary shoe cleat in accordance with the present invention.
Figure 2:
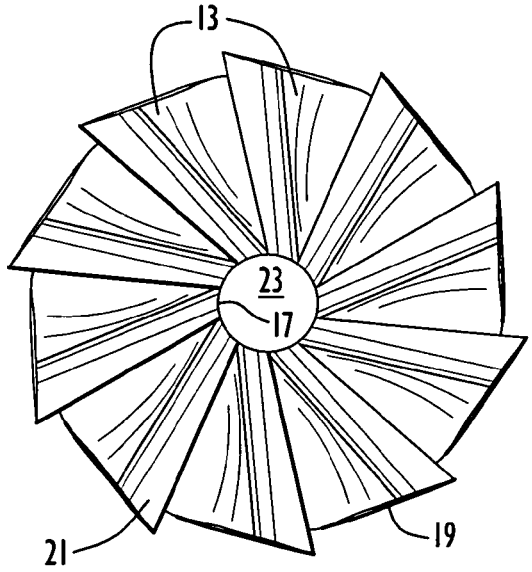
FIG. 2 is a bottom view in plan of the shoe cleat of FIG. 1.
Figure 3:
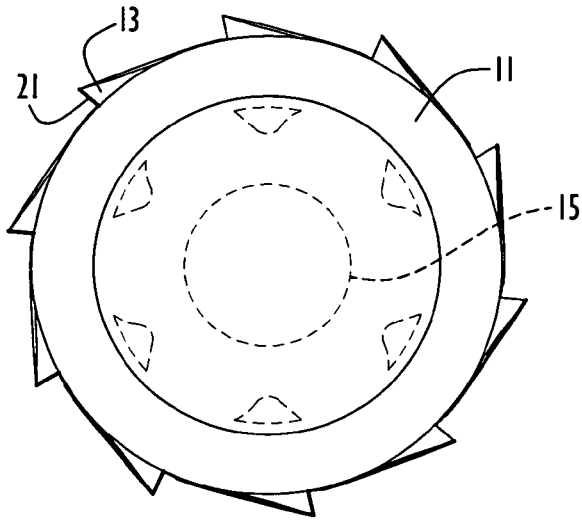
FIG. 3 is a top view in plan of the shoe cleat of FIG. 1.
Figure 4:
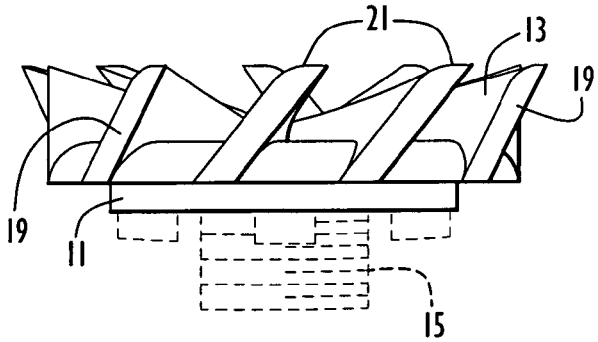
FIG. 4 is a side view in elevation of the shoe cleat of FIG. 1.

Referring specifically to FIGS. 1-4, in accordance with the present invention, traction is provided for athletic activities on turf surfaces by providing an athletic shoe having one or more cleats 10, each of which has a hub 11 with a plurality of resiliently flexible blade-like traction elements 13 extending downwardly from the hub. The cleat also preferably includes an attachment member 15, male or female, such as a threaded stud or shaft or socket or other attachment device which may be integral with, or removable from, the central hub, for attaching the cleat to a corresponding mating attachment member, such as a threaded or other engagement socket or shaft secured in the sole of an athletic shoe.

In the embodiment of FIGS. 1-4, each traction element 13 has a shape that can best be described as torsionally twisted or warped such that the array of elements resembles a turbine and each element resembles a turbine blade. Specifically, the traction element 13 is in the form of a blade-like member having a root or proximal edge 17 located at one of its ends proximate the center of the hub, and an opposite tip or distal end 19 terminating at or proximate the hub periphery. A static longitudinal edge 20 extends generally radially from the root to the tip along and secured to the hub bottom surface. A longitudinal dynamic edge 21 is disposed transversely opposite the static edge 20 and diverges relative thereto (i.e., the angle between the static and dynamic edges increases with the distance from the root to the tip of the element). Elements 13 are preferably integrally molded with the hub. The two edges 20, 21 are skewed (i.e., they do not reside in the same plane) so that the traction element is twisted torsionally along its length.

The twist of the bladed traction element is such that the static and dynamic edges are not coplanar. In the preferred embodiment, the width (i.e., vertical) dimension at the root 17 of each bladed element resides in a plane that contains or is parallel to a central longitudinal axis of the hub (in other words, perpendicular to a planar bottom surface of the hub), whereas the width dimension at the tip 19 of each element resides in a respective plane oriented at an angle (e.g., typically between 30° and 80° ) relative to the bottom surface of the hub.

As a result of the twisted configuration of traction elements 13, in the absence of applied force at least the radially outer portion of each angularly successive element overlies but does not contact a section of the hub and/or a portion of the next adjacent element 13 in the angular sequence. Accordingly, a vertical force applied to any element 13 in the direction toward hub causes that element to be compressed against the hub and/or a portion of an adjacent element.

Under load, at least the broader radially outer portion (i.e., toward the tip) of the bladed traction element resiliently flexes upward toward the hub and toward the corresponding broader portion of the adjacent bladed element. Since, in the illustrated embodiment, at least the broad distal portion of each traction element overlies part of the most adjacent bladed element, each flexed element traps grass blades against the hub and the adjacent element to provide the dynamic traction feature of the cleat. Since the traction elements need not extend significantly beyond the periphery of the hub (if at all), and since all of the flexure of the elements is toward the bottom surface of the hub, the cleat occupies a relatively small area or "footprint" at the surface of the shoe sole as compared to cleats with outwardly angled traction elements, such as that described in my '860 patent.

It will be appreciated that the angular spacing between the adjacent elements 13 at least partially determines the extent to which the bladed elements contact one another under load. Clearly, for very close angular spacing the mutual contact will be greater. At one extreme the spacing can be sufficiently great that there is no contact between elements 13 under load, and traction is effected by the elements trapping grass blades against the bottom surface of the hub. Another factor determining whether or not there is overlap and the extent thereof is the size of the bladed traction elements; specifically, the greater the width of the element 13 the more the overlap, and vice versa. Thus, for narrower elements 13 that do not extend very far from the hub surface, the overlap will be small or non-existent, and most or all of the traction is achieved by the element trapping grass against the hub as opposed to against the adjacent element. In any event, by "overlap" or "overlie" as used herein in connection with traction elements 13 it is meant that at least a portion of edge 21, when projected perpendicularly (i.e., vertically) toward the bottom surface of the hub, intersects at least a portion of an adjacent element 13.

Figure 5:
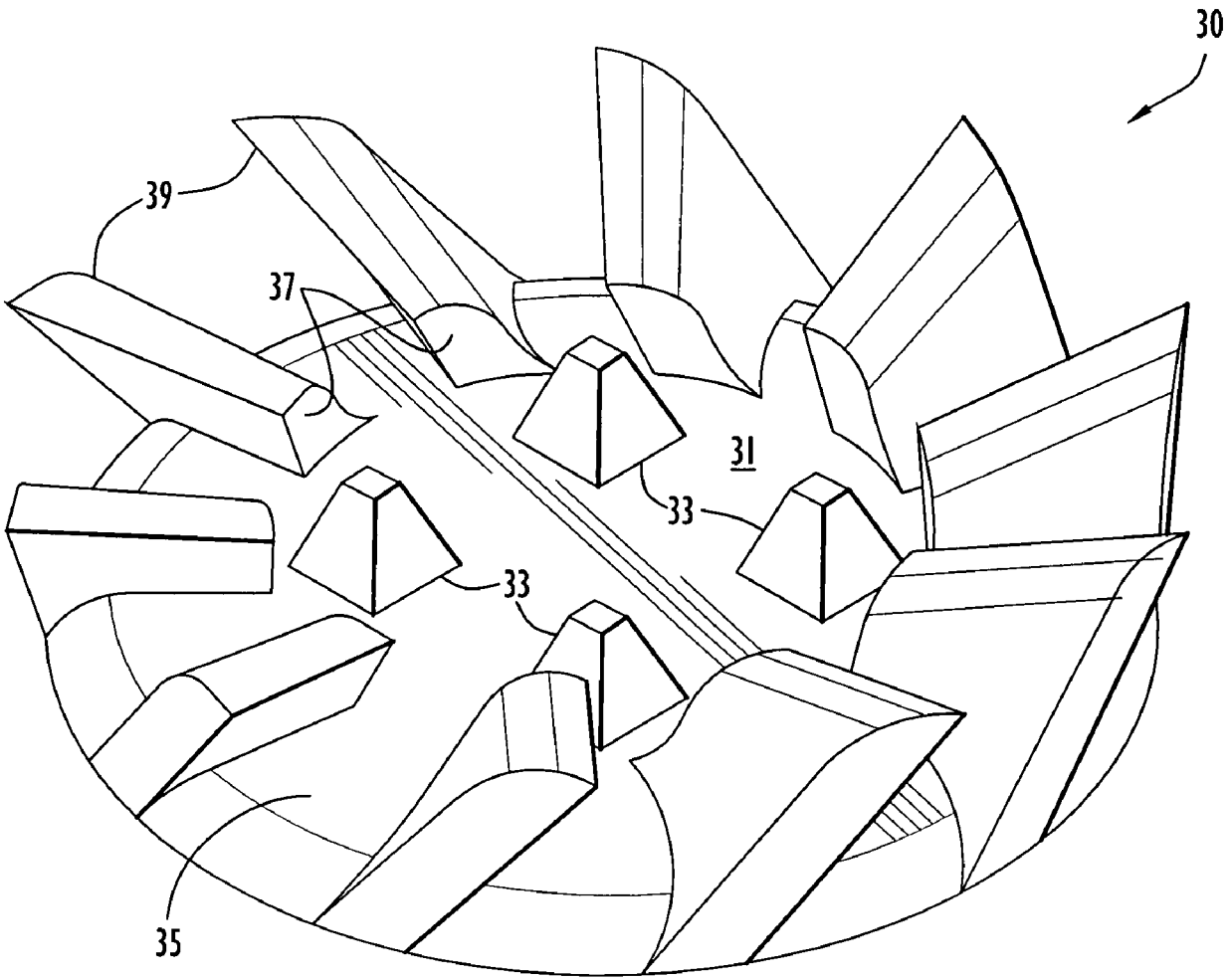
FIG. 5 is a view in perspective of the bottom or traction side of an exemplary shoe cleat in accordance with a second embodiment of the present invention.
Figure 6:
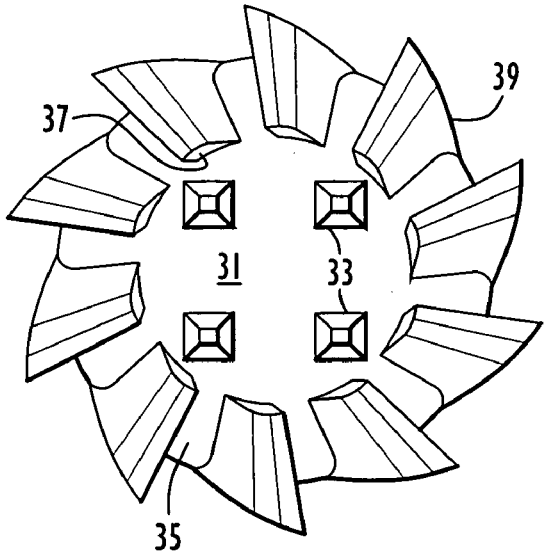
FIG. 6 is a bottom view in plan of the shoe cleat of FIG. 5.
Figure 7:
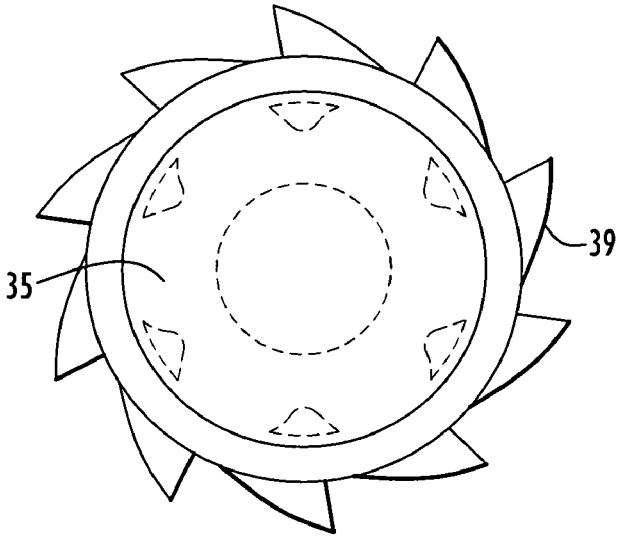
FIG. 7 is a top view in plan of the shoe cleat of FIG. 5.
Figure 8:
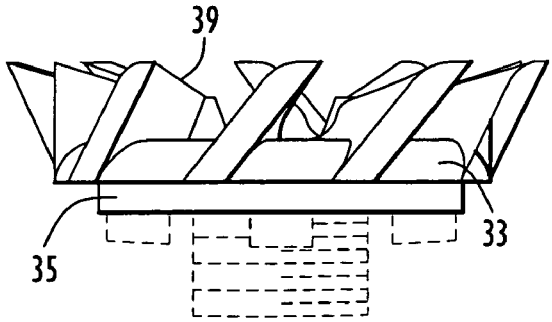
FIG. 8 is a side view in elevation of the shoe cleat of FIG. 5.

There are two preferred embodiments described and illustrated herein. In the first embodiment (FIGS. 1-4) the roots 17 of the traction elements are secured to and extend from a substantially cylindrical boss 23 elevated from the bottom surface 11 of the hub with a height corresponding to the width of each bladed element at its root. The boss diameter is typically in the range of 10% to 50% of the diameter of the hub, although this is not a limiting feature of the invention as long as the traction elements have sufficient length to be able to flex under load and trap grass blades as described herein. In a second embodiment 30 (FIGS. 5-8) the central area region 31 of the hub bottom surface 35 is provided with one or more pyramidal studs 33 that taper downwardly, and the roots (i.e., proximal edges) 37 of the traction elements 39 are located radially outward from and surround that interior space or region. In this embodiment the root edges 37 of the elements are exposed and there is no central boss from which the traction elements extend as in the first embodiment. In addition, the traction elements 39 in the second embodiment are necessarily shorter in length than the elements 13 in the first embodiment to accommodate the space needed for the studs in the center region of the hub bottom surface.

The preferred embodiments of the invention, as illustrated, have ten substantially identical bladed traction elements disposed at equal angularly spaced locations along the hub bottom surface and symmetrically about the hub central longitudinal axis (i.e., an axis disposed perpendicularly through the center of the bottom surface of the hub). It is to be understood that the number of traction elements can be changed as desired. Moreover, the principles of the invention apply whether all or only some of the traction element are bladed, whether the traction elements are equally spaced or not about the hub, whether or not all of the traction elements have the same configuration, and whether or not the traction elements are symmetrically disposed about the hub axis.

Each traction element may, but need not necessarily, be strengthened against tearing by connecting flexible webs between tips of adjacent traction elements. Such webs may generally be of the type described and illustrated in my copending U.S. patent application Ser. No. 10/915,472, (U.S. Pat. No. 7,040,043) filed Aug. 11, 2004 and entitled "Shoe Cleat", the entire disclosure of which is incorporated herein by reference. Such webs are positioned and configured to prevent clogging of the cleat with grass and/or mud in the region between the traction elements and the cleat hub.

It should be noted that, in the illustrated embodiments, the tip at the static edge of the traction elements (i.e., the edge secured to and extending along the bottom surface of the hub) terminates at the periphery of that hub surface, while the tip at the dynamic edge projects radially beyond the hub by a very short distance. This is only a preferred configuration, and the static and dynamic edges can be terminated at, inboard of, or outboard of the hub periphery, as desired for particular applications.

The dynamic edges of the traction elements are preferably beveled or rounded to eliminate or minimize damage to golf greens by distributing the forces (i.e. minimizing the pressure) exerted on greens by the traction elements under load.

In the embodiment of FIGS. 5-8 the traction elements are effectively hinged only along a single edge (i.e., the static edge) and flex under load along their entire length. On the other hand, in the embodiment of FIGS. 1-4 the root 17 is also attached to boss 23 which restrains the movement of the portion of the element near the root. Thus, in the FIG. 5-8 embodiment the traction elements under load are subjected almost entirely to compression as the hinged element is forced against the hub and/or an adjacent element, a factor which enhances the longevity of the cleat since there are substantially no forces tending to tear the traction elements. In the embodiment of FIGS. 1-4 the primary stress on the traction elements under load is likewise compression, but there is additionally a significant torsion component proximate the root which can place more stress on the element.

The studs 33 in the embodiment of FIGS. 5-8 serve two functions. First, on hard surfaces such as golf paths, the somewhat more rigid studs contact the ground after some flexure of the traction elements and thereby absorb most of the load. In other words, the studs serve as wear pads which reduce the wear on the traction elements, particularly on hard surfaces. Second, the studs provide additional traction, particularly on hard surfaces and on non-turf surfaces such as sand.

The entire cleat is preferably molded as a single unit of the same polymer material. However, it is within the scope of the invention to make/mold different portions of the cleat (e.g., the hub and traction elements and studs) of different materials to achieve desired functional (e.g., traction, strength, etc.) characteristics. Most preferably, the entire traction element, but at least the turf-engaging portion at and near the dynamic edge, is made from a resilient material such as polyurethane or other resiliently flexible elastomer. If the turf-engaging portions are made from a different material than the remainder of the cleat, these parts can be co-molded.

The bladed traction elements of the present invention provide traction on turf by the inter-engagement of the elements, and also the engagement of the elements with the hub, to trap grass blades without penetrating or puncturing the crown of any individual grass plant of the turf, and without penetrating or puncturing the soil. The traction elements extend down between the grass blades and preferably are restrained by the grass blades themselves against lateral motion, thereby providing another degree of traction. Because of the deflectable connection of the traction elements, they can be allowed to protrude into the grass blades while nevertheless avoiding or minimizing damage to the turf. In addition, the resilient flexure of the traction elements under load (i.e., weight of the shoe wearer) causes the traction elements to flex upward to trap grass blades against the hub to thereby provide traction by resisting relative movement between the cleat and the trapped grass.

The preferred embodiment of the invention is a symmetrical cleat in which bladed traction elements are equally spaced about a circular hub. It will be appreciated, however, that the principles of the invention apply to other types of cleats, including those in which the hub is asymmetrical and/or the traction elements are asymmetrically disposed. In particular, the hub may have any suitable geometric configuration consistent with the principles described herein, including, without limitation, irregularly shaped configurations, or regular circular, elliptical, rectangular, triangular or multi-sided configurations, etc. Likewise, the traction elements can be of different types on the same cleat and/or can be positioned asymmetrically to achieve desired traction functions.

As noted above, the means for attaching the cleat to a shoe, or a socket or a male connector in a shoe, does not constitute part of the invention in that any attachment and/or locking means can be utilized without departing from the principles of the invention.

Although it is preferred that the entire cleat be molded integrally from the same polymer material, it is within the scope of the invention to otherwise form the cleat such that separate parts are separately formed and later joined, and/or forming different parts of the cleat form different materials in order to optimize the intended functions of those parts.

The features of the invention apply most optimally when used with cleats in which the traction elements freely resiliently flex under load, as described. Such traction elements are referred to herein as dynamic by virtue of their movement under load which traps grass. It should be noted that the principles nevertheless apply for cleats with some static traction elements or other cleats. For example, whether or not the traction elements flex, the twisted blade traction elements as described herein function to provide traction in a compact cleat by engaging grass blades disposed between the traction elements themselves as the cleat tends to move along turf. The selection of a specific cleat design, including a selected number of each type of traction element, as well as a selected orientation of and angular spacing between the traction elements in sets on the hub, depends upon specific applications in which the cleat will be utilized and the type, amount and direction of traction that is desired for that application.

The cleat is preferably constructed of any one or more suitable plastic materials, including, without limitation, polycarbonates, polyamides (e.g., nylon), polyurethanes, natural or synthetic rubbers (e.g., styrene-butadiene), and other elastomeric polyolefins. For the dynamic elements the hardness or durometer of the material is selected to permit the bladed elements to retain their natural unflexed configuration when not under load, but to resiliently flex as described herein under the weight of the wearer of a shoe to which the cleat is affixed.

While the ground engaging dynamic edges of the traction elements are depicted as being generally rounded or otherwise convex in the drawings, it is noted that these surfaces may have other configurations, for example a flat planar configuration, depending upon the particular application, so as to enhance deflection of elements 13 as they resiliently flex under the weight of the wearer of the cleated shoe against a ground surface.

The cleat may be removably or non-removably secured to a shoe sole. Any suitable cleat connector may be utilized to removably secure the cleat to the shoe in any selected orientation. The cleat connector may include a single connecting member or a series of connecting members that combine to secure the cleat to the shoe sole. It is to be understood that, when a cleat connector includes two or more connecting members, the central axis of the cleat connector is disposed at the geometric center defined by the combination of connecting members forming the cleat connector. Any number of cleats may be combined in any number of suitable orientations to provide enhanced traction for a particular user and/or a particular activity.

It will be understood that, although the features of the present invention have particular utility for cleats used with golf shoes, the principles of the invention apply to cleats used for any sport or purpose where traction is required.

Having described preferred embodiments of shoe cleats with improved traction, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A cleat securable to the sole of a shoe for providing traction for the shoe on a ground surface, the cleat comprising:

a hub having a longitudinal axis oriented perpendicular to the hub and vertically when the sole of the shoe is on the ground, said hub having an exposed bottom surface facing away from the shoe sole when the cleat is secured to the shoe;

a plurality of blade-like traction elements extending in angularly spaced relation in a generally radial fan-like array along the bottom surface of the hub with a bottom edge of each element projecting downwardly from the hub; and a cleat connector member provided in an upper surface of the hub facing oppositely of the exposed bottom surface, wherein said connector is securable to a shoe connector member;

wherein each traction element includes:

a fixed edge extending generally radially along and secured to said bottom surface of said hub;

a dynamic edge disposed transversely opposite the fixed edge and spaced from said bottom surface of said hub; and a distal edge disposed proximate the hub periphery and extending between said dynamic and fixed edges, wherein said dynamic and fixed edges are substantially longer than said distal edge, wherein said dynamic edge is skewed relative to said fixed edge so as to not be coplanar with said fixed edge, and wherein said dynamic edge is flexibly resiliently movable relative to said fixed edge and said hub.

2. The cleat of claim 1 wherein at least a portion of one of said traction elements overlies at least a portion a second adjacent traction element when viewed along side axis.

3. The cleat of claim 1, wherein said traction elements include plural resiliently deflectable dynamic traction elements each configured to overlie an adjacent element and to be deflectable toward the hub so that, when deflected, the deflected traction element engages and traps blades of grass between itself and an adjacent dynamic traction element and between itself and the hub.

4. A cleat securable to the sole of a shoe for providing traction for the shoe on a ground surface, the cleat comprising:

a hub having a longitudinal axis oriented perpendicular to the hub and vertically when the sole of the shoe is on the ground, said hub having an exposed bottom surface facing away from the shoe sole when the cleat is secured to the shoe;

a plurality of blade-like traction elements extending in angularly spaced relation in a generally radial fan-like array along the bottom surface of the hub with a bottom longitudinal edge of each element projecting downwardly from the hub; and a cleat connector member provided in an upper surface of the hub facing oppositely of the exposed bottom surface, wherein said connector is securable to a shoe connector member;

wherein said traction elements include plural resiliently deflectable dynamic traction elements each configured to overlie an adjacent element and to be deflectable toward the hub so that, when deflected, the deflected traction element is compressed against an adjacent traction element and traps blades of grass between itself and said adjacent dynamic traction.

5. The cleat of claim 1, wherein said traction elements include plural resiliently deflectable dynamic traction elements each configured to be deflectable toward the hub so that, when deflected, the deflected traction element is compressed against the hub and traps blades of grass between itself the hub.

6. The cleat of claim 1, wherein each traction element is a resiliently deflectable traction element and has a twisted non-planar configuration.

7. The cleat of claim 6, wherein each traction element extends generally radially from a location proximate said axis and terminates distally proximate the periphery of said hub.

8. The cleat of claim 7 wherein each traction element includes proximal and distal edges extending between the fixed and bottom longitudinal edges, wherein said proximal edge is shorter than said distal edge.

9. The cleat of claim 8, further comprising a boss secured to said bottom surface of said hub proximate said axis, and wherein said proximal edge is secured to said boss.

10. A cleat securable to the sole of a shoe for providing traction for the shoe on a ground surface, the cleat comprising:

a hub having a longitudinal axis oriented perpendicular to the hub and vertically when the sole of the shoe is on the ground, said hub having an exposed bottom surface facing away from the shoe sole when the cleat is secured to the shoe;

a plurality of blade-like torsionally-twisted and resiliently flexible traction elements extending in angularly spaced relation in a generally radial fan-like array along the bottom surface of the hub with an elongated edge of each element projecting downwardly from the hub; and a cleat connector member provided in an upper surface of the hub facing oppositely of the exposed bottom surface, wherein said connector is securable to a shoe connector member;

wherein each traction element is configured to overlie an adjacent element and to be deflectable toward the hub so that, when deflected, the deflected traction element is compressed against an adjacent traction element and traps blades of grass between itself and said adjacent dynamic traction.

* * * * *